United States Patent [19]

Johnson et al.

[11] Patent Number: 4,625,851

[45] Date of Patent: Dec. 2, 1986

[54] COIN TESTING APPARATUS

[75] Inventors: Peter R. Johnson, Reading; Derek Hutchinson, Hillingdon; Peter J. Reyner, Northwood; Robert Dean, Farnham Common, all of England

[73] Assignee: Mars, Inc., McLean, Va.

[21] Appl. No.: 636,015

[22] Filed: Jul. 30, 1984

[30] Foreign Application Priority Data

Jul. 28, 1983 [GB] United Kingdom ..... 8320337

[51] Int. Cl.[4] ..... G07D 5/00

[52] U.S. Cl. ..... 194/200; 133/3 R; 194/317; 194/346

[58] Field of Search ..... 194/100 A, 100 R, 99, 194/97 R, 1 C, 1 D, 1 N, 200, 203, 317–319, 346; 133/3 R; 73/163

[56] References Cited

U.S. PATENT DOCUMENTS

| | | | |
|---|---|---|---|
| 3,916,922 | 11/1975 | Prümm | 194/1 C |
| 3,952,851 | 4/1976 | Fougere et al. | 194/100 A |
| 4,106,610 | 8/1978 | Heiman | 194/100 A |
| 4,151,904 | 5/1979 | Levasseur et al. | 194/100 A |
| 4,228,811 | 10/1980 | Tanaka et al. | 194/97 R |
| 4,257,435 | 3/1981 | Tanaka et al. | 133/3 R |
| 4,275,806 | 6/1981 | Tanaka | 194/100 A |
| 4,432,447 | 2/1984 | Tanaka | 194/100 A |

FOREIGN PATENT DOCUMENTS

| | | |
|---|---|---|
| 1401640 | 7/1975 | United Kingdom . |
| 2020469 | 5/1979 | United Kingdom . |
| 2045500 | 10/1980 | United Kingdom . |
| 2044972 | 10/1980 | United Kingdom . |
| 2107104 | 4/1983 | United Kingdom . |
| 2121580 | 12/1983 | United Kingdom . |

*Primary Examiner*—Robert B. Reeves
*Assistant Examiner*—Donald T. Hajec
*Attorney, Agent, or Firm*—Davis Hoxie Faithfull & Hapgood

[57] ABSTRACT

A coin testing apparatus subjects a coin inserted into a coin entry (1) and rolling down an inclined track (2) to testing at a testing station (3) comprising sensors (4,5,6) which may for example be inductive sensors. If a coin is found to be acceptable an accept signal is generated and this causes gate mechanism (8) to open to permit the coin to access accept path (9), the gate mechanism (8) being normally closed so that unacceptable coins can only access a reject path (10). A post-gate detector (11) in the accept path (9) senses the passage of an accepted coin and serves to close the gate mechanism (8) and also to determine allocation of a customer credit. A pre-gate detector (12) upstream of the gate mechanism (8) has its output logically processed with the accept signal produced when an acceptable coin is tested and/or with the output of the post-gate detector (11).

18 Claims, 4 Drawing Figures

COIN TESTING APPARATUS

This invention concerns improvements in or relating to coin testing apparatus as employed in vending machines and gaming apparatus for example for checking the authenticity of coins inserted into the apparatus and for providing a means of identifying foreign objects such as unacceptable coins, metal slugs, etc. so that such objects can be rejected at least in so far as concerns the allocation of credit in response to their insertion into the apparatus.

A typical coin testing apparatus, for example as described in our British Patent Specification No. 1,397,083, might comprise an inlet for coins which fall onto an energy absorbing snubber or alternative means for reducing coin bounce and then follow a predetermined path in the apparatus which takes the coin through a coin testing station where the coin is subjected to one or more authenticity tests generally, though not necessarily, by means of inductors sensitive to coin dimensions and/or to the material of which the coin is fabricated. Having negotiated the testing station, a decision is made in the light of the test results as to the acceptability of the coin. If the coin is deemed authentic and acceptable, a gate mechanism is operated so as to enable the coin to access a coin accept path, but if the coin is deemed unacceptable on the basis of the test results then the gate mechanism is not operated and, access to the accept path thus being denied, the coin is directed into a reject path for return to the customer.

A post-gate detector may be provided in the accept path for closing the gate mechanism once the verified coin has entered the accept path, the gate mechanism, which is commonly solenoid operated, being responsive to the generation of an accept signal in response to the testing of an acceptable coin for opening to provide access to the accept path, and to the generation of a signal from the post-gate detector in the accept path for closing. The post-gate detector has conveniently comprised an optical sensor, but can be a contact switch or an inductive or capacitive sensor for example, and in some arrangements has been instrumental in the allocation of a credit to the customer, that is to say that credit is not accorded to the customer in return for the insertion of a valid coin until such a time as the post-gate detector responds to the presence of such coin in the accept path.

With an arrangement as described above, the problem can arise that an unacceptable coin can either lodge on the closed gate mechanism or move off the gate mechanism relatively slowly with the result that the following insertion of an acceptable coin triggers the opening of the gate and thereby enables the unacceptable coin to access the accept path. The unacceptable coin may be a bent or otherwise damaged coin, or an excessively worn coin, or may even be a good and valuable coin but of incorrect denomination for the acceptability tests performed at the testing station. If a bent or damaged coin or a coin of the wrong size and/or shape enters the accept path, then problems of jamming or otherwise disabling of following coin sorting and storing mechanisms which are commonly provided can arise. Faceted coins such as a British 20 pence or 50 pence coin are more likely to stall on the gate mechanism than circular coins even when in reasonable condition so that, for example, a 20 pence coin inserted in error for a 5 pence coin and correspondingly deemed unacceptable can, if followed by a second-inserted acceptable coin, enter the accept path. Thereafter the second-inserted and acceptable coin may quickly follow the first coin into the accept path, in which case the customer will obtain only one credit for his two coins, or alternatively the closure of the gate mechanism initiated by the first coin encountering the post-gate detector may cause the second coin to be caught and held by the closing gate (in which case the customer again only gets one credit for two coins) or may cause the second coin to be rejected by the closed gate.

The situation can arise even with acceptable coins that the insertion of two coins one after the other, particularly though not necessarily in rapid succession, can result either in both coins entering the accept path substantially together and not only registering only one customer credit but also potentially causing coin jamming problems in following coin sorting and storage mechanisms, or in the second coin being caught and held by the gate mechanism as it closes in response to the first coin. In the aforementioned British Patent Specification No. 1,397,083 a solution to this problem is sought by detecting the arrival of the coins at the testing station and rejecting both coins if they follow each other too closely, and other arrangements are known in which a second inserted coin following too closely upon a first coin in passage through the testing station will cause the first coin to be rejected irrespective of whether or not it is a good coin and only the second-inserted coin can be accepted. However, neither of these approaches can offer a solution to the problem which can arise, particularly where the distance between the first and last sensors of the testing station is comparable with the distance from the last such sensor to the gate mechanism, that two properly inserted coins pass separately through the testing station but nonetheless arrive at the gate more or less simultaneously by virtue of taking different flight paths through the coin path.

The present invention is directed primarily to the combatting of the problems described above but has more general application. The invention resides in the provision of a detector upstream of the gate mechanism and downstream of the testing station for signalling the presence of a coin or other object in the coin path at the detector location. The signal provided by such a pre-gate detector can be processed in a number of ways, as will hereinafter be described, with other signals representative of the presence of an object elsewhere in the apparatus. For example, the detector signal can be processed with a signal representative of the presence concurrently of another object upstream of the detector location, such signal for example being an accept signal generated in response to the testing of an acceptable coin or being a signal indicative of the presence of a coin for example at the testing station, and/or can be processed with a signal developed by a further, post-gate detector.

A coin testing apparatus in accordance with the present invention will thus have a coin path defined therein, a testing station in said coin path having means for subjecting a coin to one or more tests for authenticity, a detector located downstream of the testing station for signalling the presence of a coin or other object in the coin path at the detector location, and a gate mechanism in the coin path downstream of the detector and operable in response to the testing of an acceptable coin to permit access for such coin to an accept path and otherwise preventing such access.

The apparatus according to the invention may for example furthermore be such as to be responsive to the detector signalling the presence of an object downstream of the test station and upstream of the gate mechanism at the same time as an accept signal is generated in response to the testing of an acceptable coin. In an apparatus where the gate mechanism is opened in response to the generation of such an accept signal, the detector might for example be arranged to sense an object, which might be a coin or a foreign body, stalled on the gate and the detector signal might be utilized to inhibit the opening of the gate in response to a coin accept signal from the coin testing station so long as the object remains on the gate. Alternatively, the signal from the detector could be logically processed with another signal which might be generated at the test station or elsewhere in the coin path upstream of the detector and might merely represent the presence of a coin or other object at the test station or elsewhere in the coin path and be unconnected with the result of the acceptability test conducted in the test station. Such arrangements would not only be effective in the circumstances of a coin or other object stalled on the gate mechanism, but also would be similarly effective in the event of two coins following each other along the coin path at a spacing considered to be excessively close to enable separate and proper testing of both coins. With the pre-gate detector positioned to be responsive to all genuine coins in an area just above the gate and arranged to inhibit the opening of the gate in response to a following acceptable coin, the aforementioned problem will not result in a coin jam or result in the customer obtaining only one credit for two coins.

Alternatively, or additionally, in a coin testing apparatus according to the invention which is provided with a post-gate detector as aforementioned, the pre-gate detector provided downstream of the testing station and upstream of the gate mechanism may have its output logically coupled with the output of the post-gate detector in order, for example, to ensure that the post-gate detector does not signal a customer credit allocation at a time when the pre-gate detector is signalling the presence of an object. Such a circumstance might arise for example if a foreign object accidentally or maliciously introduced into the apparatus were to come to rest, at least temporarily, on the gate and then an acceptable coin were to be introduced so as to cause the gate to open with the result that the foreign object registered a customer credit through operation of the post-gate detector; if the acceptable coin was signalled by the pre-gate detector around the time when the post-gate detector signalled the presence of an object in the accept path, then a situation might be presumed to exist which would warrant the allocation of a customer credit by the post-gate detector being denied.

Such a situation would be combatted by the present invention even if the foreign object were of such a small size as not to be detectable by the pre-gate detector. A foreign object, such as a loose screw within the machine, for example, might be sufficient to trigger the generation of a customer credit by the post-gate detector but, if lying on the gate mechanism, might not be signalled by the pre-gate detector; obviously this would depend upon the particular nature of the respective detectors. With a small foreign object lying undetected on the gate, the insertion of an acceptable coin could then by opening the gate cause the foreign object to access the accept path and generate a credit, but if the acceptable coin were to be sensed by the pre-gate detector generally at the time the foreign object was signalled by the post-gate detector then the credit could be negated. Since the detection of the small foreign object by the post-gate detector would re-close the gate, the acceptable coin would be returned to the customer so justifying the denial of credit.

The pre-gate detector (the detector provided in accordance with the teachings hereof will for convenience be so referred to hereinafter even though as previously indicated in some arrangements envisaged according to the invention there may be no gate mechanism and no post-gate detector) may comprise a photoemitter/photodetector arrangement. A particularly convenient arrangement which might be employed is described in our British Patent Application No. 2044972 and comprises a light source transmitting a beam of light across the coin path to be received by a prism and redirected thereby back across the coin path to a photodetector. By virtue of this arrangement the light beam traverses the coin path a plurality of times at spaced apart locations which increases the probability of an irregularly shaped object or a relatively small object, as compared with the coin path width, being detected. A similar arrangement might advantageously be employed for the post-gate detector.

The precise positioning of the pre-gate detector in relation to the coin testing station and in relation to the position of the gate mechanism will depend upon the particular circumstances and the intended application. From the foregoing it will be clear that the positioning of the pre-gate detector with respect to the coin testing station and to the post-gate detector is critical if erroneous denial of customer credit is to be avoided. For an application where the requirement is for the pre-gate detector to be capable of signalling the presence of an object concurrently with the generation of a signal in response to the presence of a coin in the testing station, the last-mentioned signal being for example a coin presence signal merely indicating the presence of a coin or indeed of a different object at the coin testing station or alternatively being for example a coin accept signal generated when an acceptable coin has successfully negotiated the testing station, the pre-gate detector will be located at least such a distance downstream from the general location in the coin path where the coin present or coin accept signal respectively is generated that the largest coin to be accepted by the apparatus cannot concurrently generate a signal from the testing station and a signal from the pre-gate detector. Having thus determined the distance of the pre-gate detector downstream of the testing station, its distance upstream of the gate mechanism where such is provided desirably should not be such that a relatively substantial object could remain on the gate without its presence there being signalled by the detector, that is of course if the arrangement is to be capable of overcoming the problems aforementioned. A particularly convenient detector arrangement might have the detector operative to detect anything within a range of sizes and the aforementioned arrangement of our British Patent Application No. 2044972 in which a light beam crosses and recrosses the coin path a plurality of times might be employed to provide the requisite detector capability.

Where the pre-gate detector is required to operate in conjunction with a post-gate detector, the spacing apart of the two detectors requires consideration. With the apparatus arranged such that concurrent signalling by both detectors of the presence of an object was to be interpreted as an irregular condition, then the pre-gate and post-gate detectors would need to be spaced apart by a distance at least slightly greater than the span of the largest coin to be tested.

It will be appreciated from the foregoing that the invention is susceptible of modification and variation depending upon the application or applications to which it is applied in a coin testing apparatus. In the following there will be described in general outline an exemplary embodiment for the purpose of further explaining the invention. The embodiment in question is illustrated in the accompanying drawings wherein.

Figure 1:
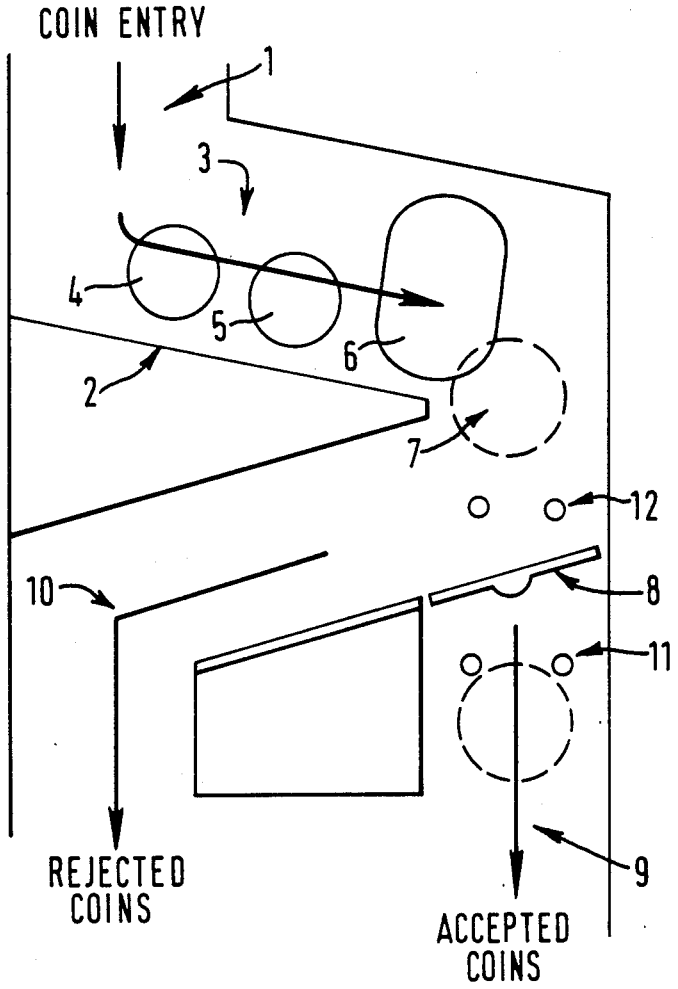
FIG. 1 is a schematic showing of a coin validation apparatus embodying the present invention.
Figure 1A:
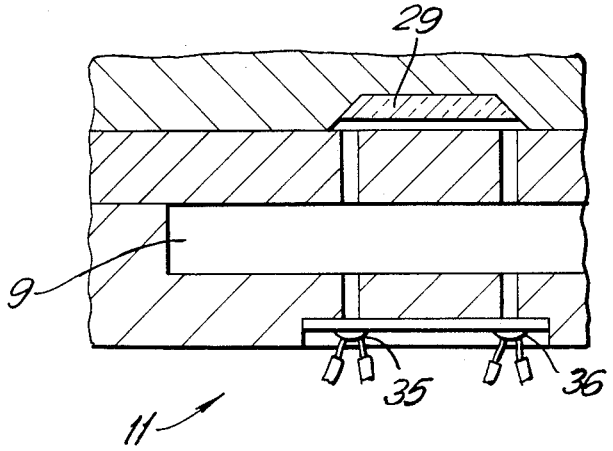
FIG. 1A shows one embodiment of a post-gate detector suitable for use in the present invention.

Referring to the drawing, FIG. 1 illustrates a typical coin validating apparatus provided in accordance with the invention with a pre-gate detector. As shown, a coin enters the apparatus at coin entry 1, falls onto an energy absorbing snubber (not shown) and follows an inclined path 2 which takes the coin through a testing station 3 shown by way of example as comprising three sensors 4, 5 and 6 which may be inductive sensors or may be of other types. As the coin leaves the field of the third sensor 6 a decision will be made regarding its validity in dependence upon the results of the tests performed on the coin by the three sensors, this decision generally being made and resulting in an accept signal being produced if the coin is deemed acceptable at a time when the coin is located generally about the position indicated by the broken circle 7. Downstream of the testing station in the coin path there is provided a gate mechanism 8 which comprises a solenoid-operated gate which is normally closed to deny access to an accept coin path 9 for coins arriving at the gate from the testing station 3, the coins thus denied access to the accept path 9 then taking the alternative reject path 10. In response to the generation of an accept signal following testing of a coin in the test station 3, the solenoid-operated gate 8 is withdrawn so as to enable coins falling from the testing station 3 to enter the accept path 9. A post-gate detector 11 downstream of the gate 8 signals the arrival of the accepted coin and this signal is generally utilized for initiating closure of the gate 8 and, either alone or in conjunction with other signals derived for example from the testing station 3 and indicative of coin denomination, can be utilized to initiate the granting of a customer credit in return for the accepted coin. As mentioned hereinbefore, the post-gate detector may conveniently be constructed as described in our British Patent Application No. 2044972, and shown in FIG. 1A. Briefly, such a post-gate detector 11 comprises an arrangement along the accept path 9 of a photoemitter 35, a photodetector 36 and means 29 to cause light from the photoemitter 35 to transverse the coin path a plurality of times. Additional details may be found in the commonly assigned above referred application.

In accordance with the present invention, a pre-gate detector 12 is provided upstream of the gate 8 and downstream of the testing station 3. The pre-gate detector preferably is of the same type and construction as the post-gate detector and preferably is of the type described in our British Patent Application No. 2044972.

As hereinbefore explained, an unacceptable coin or other foreign object, particularly a non-circular coin or object, can come to rest, at least temporarily, on the gate 8 so that a subsequently inserted acceptable coin causes the gate 8 to open thereby permitting the unacceptable coin or foreign object to fall into the accept path 9, establish credit at the post-gate detector 11 and cause the gate 8 to close, whereupon the acceptable coin enters the reject path. To combat this problem in the case where an unacceptable coin or a foreign object generally of the same size as a coin is the cause of the problem, the present invention provides that the accept signal developed by the second-inserted, acceptable coin is negated if at the time of its generation the pre-gate detector signals the presence of an object on the gate.

To combat the same problem arising with a small foreign object which can rest on the gate without its presence being signalled by the pre-gate detector, the present invention provides that the customer credit allocation is inhibited, if during the period when the post-gate detector signals the presence of the foreign object in the accept path 9 following the generation of an accept signal, the pre-gate detector signals the presence of the subsequently inserted acceptable coin.

So long as the arrangement is such that one and the same coin will not produce an accept signal from the testing station 3 at the same time as the pre-gate detector 12 signals its presence, the arrangement can be made as sensitive or as insensitive as may be desired according to the closeness or remoteness respectively of the pre-gate detector 12 relative to the accept signal generation location 7. An arrangement possessing advantageous characteristics might be constructed in accordance with the teachings of our British Patent Application No. 2044972 such that a light beam crosses the coin path a plurality of times between a source and a detector at a first plurality of locations selected such that even a very small object lying on the gate 8 will be detected and also at a second plurality of locations extending between the gate 8 and the accept signal generation location 7 such that a larger object will be detected.

The described embodiment of the invention also has other benefits in the normal operation of the coin validator. The non-circular object abovementioned could be a valid non-circular coin such as the UK 20p or 50p which has been rejected. A cause for rejection could be that a second coin has been inserted too quickly behind the first coin. This first, non-round coin, could stop momentarily on the gate before slowly rolling off the gate. The second coin opens the accept gate. The first coin, which should have been rejected, falls into the accept chute; the second coin, which should have been accepted, either rolls off the now closed gate or is trapped by the closing gate. If it is trapped by the gate, it falls into the post-gate detector when the gate is opened for the next valid coin and so the fault condition is perpetuated. By virtue of the present invention the presence of the first coin on the gate will be signalled when the accept signal for the second coin is generated thereby inhibiting the opening of the gate and causing neither coin to be accepted.

Figure 2:
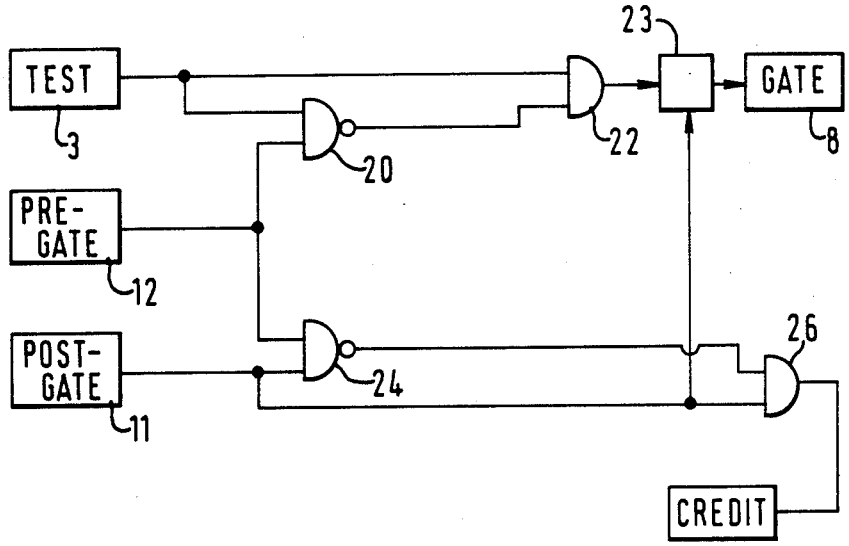
FIG. 2 is a block diagram showing a schematic circuit diagram of the coin validation apparatus of FIG. 1.
Figure 3:
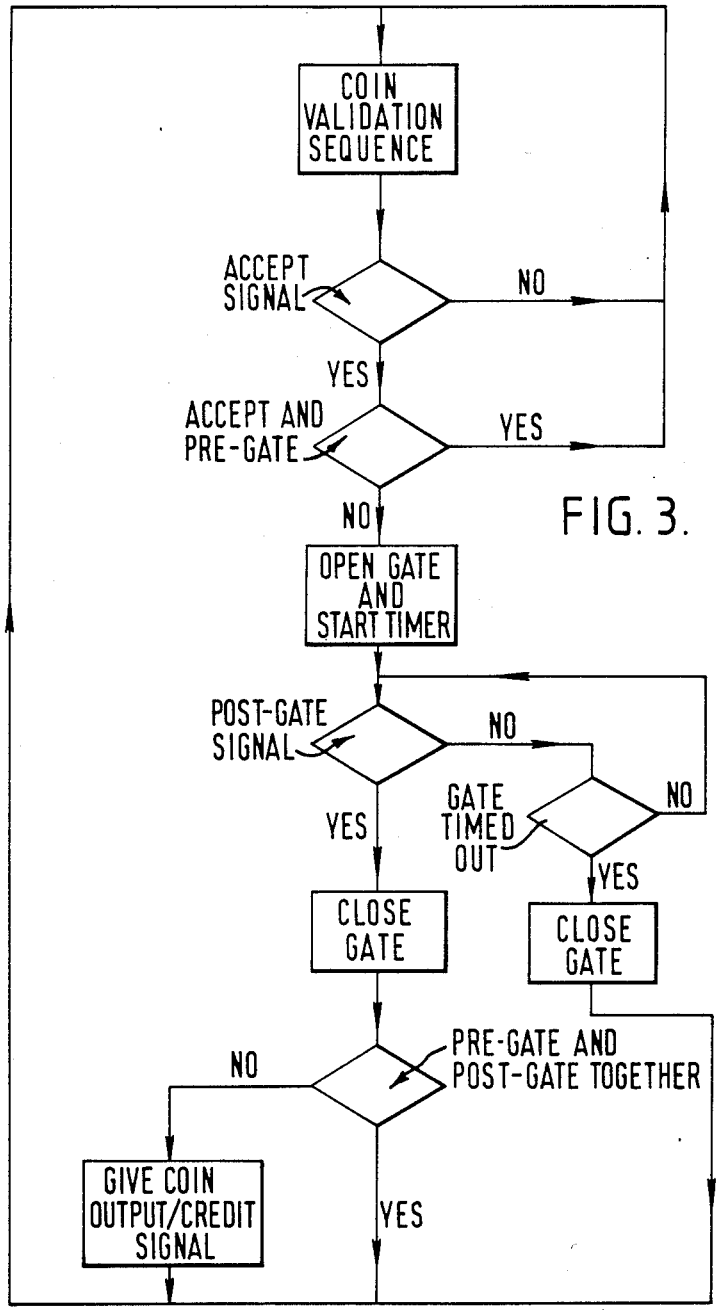
FIG. 3 is a flow chart indicating the operation of the apparatus.

FIGS. 2 and 3 respectively show a simplified and schematic circuit diagram of the above-described embodiment and a flow chart representing the operation of the embodiment. Whilst a hard-wired embodiment may be conveniently and inexpensively produced, the possibility exists that an apparatus according to the invention might have its signal processing organized under microprocessor control. Indeed, coin testing apparatuses which incorporate a microprocessor are already known and it may be convenient that such a microprocessor also controls the signal processing required to practice the present invention.

In FIG. 2, the testing station 3, pre-gate detector 12 and post-gate detector 11 are schematically shown. A NAND gate 20 responds to the presence of an output from the pre-gate detector 12 concurrently with the generation of an accept signal by the test station 3 to provide an output to inhibit the provision of the inputs necessary to enable AND gate 22 to pass a set signal to latch 23 in order to initiate opening of the gate 8. Similarly the existence of an output from pre-gate detector 12 at the same time as an output appears from post-gate detector 11 will give rise to a signal generated by means of NAND gate 24 for inhibiting the passage through AND gate 26 of a credit allocating signal.

FIG. 3 will be clear to those possessed of appropriate skills without need for further explanation.

There has thus been described an improved coin testing apparatus capable of combatting the problems arising from the situation in which an unacceptable coin or other object stalls on the gate mechanism of the apparatus and is caused to travel through the accept path with corresponding generation of credit when the gate is opened in response to a subsequently inserted acceptable coin. As described, the apparatus has wider application though than this and can be useful for example also in a situation where two coins inserted one after another arrive at the gate mechanism following each other too closely, which can occur particularly where the length of the coin path in the validation area is similar to the distance between the last sensor of the testing station and the gate mechanism. The embodiment described is exemplary only of the possibilities embraced by the invention and it is to be appreciated that many modifications and variations of the described embodiment are possible.

We claim:

1. A coin testing apparatus comprising a coin path, a testing station in said coin path, means responsive to the presence of an object in the testing station for generating a control signal, a gate mechanism in the coin path downstream of the testing station, the gate mechanism being operable in response to the testing of an acceptable coin to permit access for such coin to an accept path and otherwise preventing such access, a pre-gate detector located upstream of the gate mechanism and downstream of the testing station and downstream of the general location in the coin path whereat an object would be located at the time of generation of said control signal by at least such a distance that the largest coin to be accepted by the apparatus cannot concurrently be detected by the detector and be responsible for the generation of said control signal, the pre-gate detector being responsive to coins and other objects for signalling the presence of an object in the coin path close to the gate mechanism, and means for inhibiting such operation of the gate mechanism as would permit access to the accept path when said pre-gate detector signals the presence of an object close to the gate mechanism and said control signal is generated in response to the presence at the same time of another object in the testing station.

2. Apparatus as claimed in claim 1, wherein said inhibiting means is arranged to be responsive to the pre-gate detector signalling the presence of one object and to the testing station signalling the presence of another object, by generation of said control signal.

3. Apparatus as claimed in claim 2, wherein said control signal comprises an accept signal generated when a tested coin is found to be acceptable.

4. Apparatus as claimed in claim 3, wherein the gate mechanism is operable in response to an accept signal to permit access to the accept path for an acceptable coin in transit from the testing station, and in response to the pre-gate detector signalling the presence of one object and an accept signal being generated responsive to the presence of another object, namely an acceptable coin, at the testing station, operation of said gate mechanism to permit access to the accept path is inhibited.

5. Apparatus as claimed in claim 1, wherein a detector is provided in the accept path downstream of the gate mechanism for signalling the presence of an object in the accept path.

6. Apparatus as claimed in claim 5, wherein the signalling by the post-gate detector of an object in the accept path is arranged to control the closure of the gate mechanism.

7. Apparatus as claimed in claim 5, wherein the signalling by the post-gate detector of an object in the accept path is arranged to initiate the giving of a customer credit.

8. Apparatus as claimed in claim 5, wherein the pre-gate and post-gate detectors are spaced apart by a distance at least slightly greater than the span of the largest coin to be accepted by the apparatus, and means are provided responsive to the pre-gate detector signalling the presence of one object when the post-gate detector signals the presence of another object for detecting an irregular condition.

9. Apparatus as claimed in claim 8, wherein the signalling by the post-gate detector of an object in the accept path is normally arranged to initiate the giving of a customer credit, and the signalling by the pre-gate detector of the presence of an object when the post-gate detector signals the presence of another object is arranged to inhibit the giving of a customer credit.

10. Apparatus as claimed in claim 1, wherein the pre-gate detector comprises a photoemitter, a photodetector in the beam path of said photoemitter, and means to cause said beam path to traverse the coin path a plurality of times at different locations.

11. A coin testing apparatus comprising a coin path, a testing station in said coin path including means for indicating the presence of an object within the testing station, a gate mechanism in the coin path downstream of the testing station, the gate mechanism being operable in response to the testing of an acceptable coin to permit access for such coin to an accept path and otherwise preventing such access, a pre-gate detector located upstream of the gate mechanism and downstream of the testing station for signalling the presence of an object in the coin path close to the gate mechanism, a post-gate detector located in said accept path for signalling the presence of an object in the accept path downstream of the gate mechanism, said pre-gate detector being located relatively closely to said gate mechanism and being spaced from the general location in said coin path whereat an acceptable coin will be when it is recognized as being acceptable by a distance at least slightly greater than the span of the largest coin to be accepted by the apparatus, and said pre-gate and post-gate detectors being spaced apart from each other by a distance at least slightly greater than the span of said largest coin, means responsive to the pre-gate detector signalling the presence of an object when the post-gate detector signal the presence of another object for sensing a first irregular, condition, and means responsive to the pre-gate detector signalling the presence of an object when an indication is provided of the presence of another object within the testing station for sensing a second irregular condition.

12. Apparatus as claimed in claim 11, wherein the signalling of the presence of an object by the post-gate detector is normally arranged to initiate the giving of a customer credit, and wherein, in response to the pre-gate detector signalling the presence of an object when the post-gate detector signals the presence of another object, the giving of a customer credit is inhibited.

13. Apparatus as claimed in claim 11 wherein, in response to the post-gate detector signalling the presence of an object, closure of the gate mechanism is initiated.

14. Apparatus as claimed in claim 11 further comprising means for inhibiting such operation of the gate mechanism as would permit access to the accept path when the pre-gate detector signals the presence of an object and the testing station indicates the presence of another object in the coin path upstream of the pre-gate detector.

15. Apparatus as claimed in claim 14, wherein the inhibiting means is arranged to be responsive to the pre-gate detector signalling the presence of an object and to an accept signal generated when a tested coin constituting said another object is found to be acceptable.

16. Apparatus as claimed in claim 11, wherein each of the pre-gate and post-gate detectors comprises a photoemitter, a photodetector in the beam path of said photoemitter and means to cause said beam path to traverse the coin path a plurality of times at different locations.

17. A coin testing apparatus for testing a variety of differently sized coins comprising a downwardly inclined coin path along which coins to be tested are adapted to move under gravitational influence, a testing station in said coin path for testing coins for autheticity, means for providing an accept signal if the result of the test indicates an acceptable coin, and means for routing a tested coin selectively to one of an accept path and a reject path depending upon whether or not an accept signal is provided, the routing means including a gate mechanism disposed below the lowermost end of the coin path so as normally to obstruct access to the accept path for coins falling from the coin path after testing and permit access only to the reject path, but operable in response to an accept signal to permit access to the accept path, the apparatus further including a pre-gate detector located upstream of the gate mechanism by a distance no greater than the span of the smallest coin to be accepted by the apparatus and downstream of the location whereat an acceptable coin will generally be when the corresponding accept signal is generated by a distance greater than the span of the largest coin to be accepted by the apparatus, the pre-gate detector thereby being responsive to coins and other like-sized objects stalled on the gate mechanism, and means responsive to said detector signalling the presence of an object substantially simultaneously with the production of an accept signal for inhibiting such operation of said gate mechanism as permits access to the accept path.

18. A coin testing apparatus for testing a range of differently sized coins comprising a testing station for testing a coin for authenticity, means for providing an accept signal if the test result indicates an authentic coin, and means for routing a tested coin selectively to one of an accept path and a reject path depending upon whether or not an accept signal is provided, the routing means including a gate mechanism normally obstructing access to the accept path and permitting access only to the reject path but operable in response to an accept signal to permit access to the accept path, the apparatus further including a post-gate detector located in said accept path downstream of the gate mechanism for signalling the presence of an object in the accept path, means responsive to said post-gate detector signalling the presence of an object in the accept path for allocating a customer credit, a pre-gate detector located upstream of the gate mechanism and downstream of the testing station for signalling the presence of an object between the testing station and the gate mechanism, and means responsive to said pre-gate detector signalling the presence of an object upstream of the gate mechanism generally simultaneously with generation of an accept signal for inhibiting operation of said gate mechanism and generally simultaneously with said post-gate detector signalling the presence of an object downstream of the gate mechanism for inhibiting the operation of said credit allocating means, said pre-gate and post-gate detectors being spaced apart from each other by a distance at least slightly greater than the span of the largest coin to be accepted by the apparatus, said pre-gate detector being located upstream of the gate mechanism by a distance no greater than the span of the smallest coin to be accepted by the apparatus and downstream of the general region whereat an acceptable coin is when a corresponding accept signal is generated by a distance greater than the span of the largest coin to be accepted by the apparatus.

* * * * *

UNITED STATES PATENT AND TRADEMARK OFFICE

CERTIFICATE OF CORRECTION

PATENT NO. : 4,625,851

DATED : December 2, 1986

INVENTOR(S) : Johnson et al.

It is certified that error appears in the above-identified patent and that said Letters Patent is hereby corrected as shown below:

Col. 9, claim 11, line 7, change "signal" to --signals--.

Col. 9, claim 11, lines 8-9, delete the comma (,) after "irregular."

Signed and Sealed this

Seventeenth Day of July, 1990

*Attest:*

HARRY F. MANBECK, JR.

*Attesting Officer*

*Commissioner of Patents and Trademarks*